United States Patent [19]

Malhotra et al.

[11] Patent Number: 5,068,140

[45] Date of Patent: Nov. 26, 1991

[54] TRANSPARENCIES

[75] Inventors: Shadi L. Malhotra; Maria L. Martins, both of Mississauga; Maya D. Stevanovic, Weston; Arthur Y. Jones, Mississauga, all of Canada

[73] Assignee: Xerox Corporation, Stamford, Conn.

[21] Appl. No.: 388,449

[22] Filed: Aug. 2, 1989

[51] Int. Cl.[5] ..... B41M 5/00

[52] U.S. Cl. ..... 428/216; 346/135.1; 428/195; 428/411.1; 428/474.7; 428/476.3; 428/479.3; 428/480; 428/481; 428/480; 428/500; 428/507; 428/521; 428/522; 428/536; 428/914

[58] Field of Search ..... 428/195, 212, 474.4, 428/411.1, 500, 532, 213, 215, 216, 476.3, 479.3, 480, 481, 483, 507, 521, 522, 536, 913, 914

[56] References Cited

U.S. PATENT DOCUMENTS

| | | | |
|---|---|---|---|
| 2,993,793 | 7/1961 | Beersmans et al. | 96/87 |
| 3,488,189 | 1/1970 | Mayer et al. | 96/1.5 |
| 3,493,412 | 2/1970 | Johnston et al. | 117/17.5 |
| 3,535,112 | 10/1970 | Dolce et al. | 96/1.4 |
| 3,539,340 | 11/1970 | Dolce et al. | 96/1.4 |
| 3,539,341 | 11/1970 | Dolce et al. | 96/1.4 |
| 3,615,555 | 10/1971 | Koeln-Flittard et al. | 96/87 R |
| 3,619,279 | 11/1971 | Johnston et al. | 117/155 UA |
| 3,833,293 | 9/1974 | Serio et al. | 355/17 |
| 3,854,942 | 12/1974 | Akman | 96/1.2 |
| 3,861,942 | 1/1975 | Guestaux | 117/34 |
| 4,209,584 | 6/1980 | Joseph | 430/527 |
| 4,234,644 | 11/1980 | Blake et al. | 428/204 |
| 4,259,422 | 3/1981 | Davidson et al. | 430/17 |
| 4,419,004 | 12/1983 | Kuehnle | 355/3 TR |
| 4,419,005 | 12/1983 | Kuehnle | 355/3 TR |
| 4,480,003 | 10/1984 | Edwards et al. | 428/329 |
| 4,503,111 | 3/1985 | Jaeger et al. | 428/195 |
| 4,564,560 | 1/1986 | Tani et al. | 428/411.1 |
| 4,578,285 | 3/1986 | Viola | 428/195 |
| 4,592,954 | 6/1986 | Malhotra | 428/335 |
| 4,654,284 | 3/1987 | Yu et al. | 430/59 |

*Primary Examiner*—Pamela R. Schwartz
*Attorney, Agent, or Firm*—E. O. Palazzo

[57] ABSTRACT

A transparent substrate material for receiving or containing an image comprised of a supporting substrate, an anticurl coating layer or coatings thereunder, and an ink receiving layer thereover.

17 Claims, No Drawings

TRANSPARENCIES

BACKGROUND OF THE INVENTION

This invention relates generally to transparencies, and more specifically the present invention is directed to transparencies with anticurl coatings, and the use of these transparencies in ink jet printing processes, and xerographic imaging and printing processes. In one embodiment, the present invention relates to transparencies comprised of a supporting substrate with an ink receiving layer thereover, and an anticurl layer or layers thereunder, which transparencies are particularly useful in xerographic imaging and ink jet printing processes, including color processes. More specifically, the transparencies of the present invention can be selected for the Xerox Corporation 4020 TM color ink jet printer wherein curling is avoided or minimized. Additionally, in another embodiment of the present invention there are provided papers for ink jet printing, which papers contain thereover and thereunder the layered coatings illustrated hereinafter with optional fillers such as colloidal silica dispersed in the top ink receiving coating, for example, in an amount of from about 40 to about 60 percent by weight. The coated paper substrates of the present invention may also be incorporated into electrostatographic imaging processes, including color processes.

A variety of transparencies are known, reference for example U.S. Pat. Nos. (1) 3,535,112 which illustrates transparencies with polyamide overcoatings; (2) 3,539,340 wherein transparencies with poly(vinyl chloride) overcoatings are described; (3) 4,072,362 which discloses transparencies with overcoatings of styrene acrylate or methacrylate ester polymers; (4) 4,085,245 wherein there are disclosed transparencies with blends of acrylic polymers and vinyl acetate polymers; (5) 4,259,422 which discloses, for example, transparencies with hydrophilic colloids; (6) 4,489,122 wherein there are disclosed transparencies containing elastomeric polymers overcoated with poly(vinylacetate), or terpolymers of methylmethacrylate, ethyl acrylate, and isobutyl acrylate; and (7) 4,526,847 which discloses transparencies containing coatings of nitrocellulose and a plasticizer. The disclosures of each of the aforementioned patents are totally incorporated herein by reference.

Ink jet printing systems are well known. Thus, for example, there is illustrated in U.S. Pat. No. 3,846,141, the disclosure of which is totally incorporated herein by reference, a composition for ink jet printing comprised of an aqueous solution of a water soluble dye and a humectant material formed of a mixture of a lower alkoxy triglycol, and at least one other compound selected from the group consisting of a polyethylene glycol, a lower alkyl ether of diethylene glycol, and glycerol. According to the disclosure of this patent, the viscosity of the printing inks is subjected to little variation with use in that water is lost by evaporation during recirculation of the ink composition through the jet printer. Moreover, apparently the humectant system disclosed in this patent substantially prevents or minimizes tip drying of the printing ink in the orifice or nozzle during down time of the printer such as when the printer is rendered inoperative.

There are illustrated in U.S. Pat. No. 4,279,653 ink jet compositions containing water soluble wetting agents, a water soluble dye and an oxygen absorber. Similarly, U.S. Pat. No. 4,196,007 describes an ink jet printing composition containing an aqueous solution of water soluble dye and a humectant consisting of at least one water soluble unsaturated compound. Other patents disclosing aqueous inks for ink jet printing include U.S. Pat. Nos. 4,101,329; 4,290,072 and 4,299,630, the disclosures of which are totally incorporated herein by reference.

Ink jet recording methods and ink jet transparencies employing the above-mentioned or similar inks are well known. There is illustrated in U.S. Pat. No. 4,446,174, the disclosure of which is totally incorporated herein by reference, an ink jet recording method for producing a recorded image on an image receiving sheet with aqueous inks, and wherein an ink jet is projected onto an image receiving sheet comprising a surface layer containing a pigment, which surface layer is capable of adsorbing a coloring component present in the aqueous ink. Also, there is disclosed in U.S. Pat. No. 4,371,582 an ink jet recording sheet containing a latex polymer, which can provide images with excellent water resistance properties and high image density by jetting them onto an aqueous ink containing a water soluble dye. Similarly, U.S. Pat. No. 4,547,405, the disclosure of which is totally incorporated herein by reference, describes an ink jet recording sheet comprising a transparent support with a layer comprising 5 to 100 percent by weight of a coalesced block copolymer latex of poly(vinyl alcohol) with polyvinyl(benzyl ammonium chloride), and 0 to 95 percent by weight of a water soluble polymer selected from the group consisting of poly(vinyl alcohol), poly(vinyl pyrrolidone), and copolymers thereof.

Other layered coatings for ink jet transparencies include blends of carboxylated polymers with poly(alkylene glycol), reference U.S. Pat. No. 4,474,850, the disclosure of which is totally incorporated herein by reference; blends of poly(vinyl pyrrolidone) with matrix forming polymers such as gelatin; or poly(vinyl alcohol) swellable by water and insoluble at room temperature but soluble at elevated temperatures, reference U.S. Pat. No. 4,503,111; and blends of poly(ethylene oxide) with carboxymethyl cellulose as illustrated in U.S. Pat. No. 4,592,954, the disclosure of which is totally incorporated herein by reference.

The transparencies of U.S. Pat. No. 4,592,954 do not contain anticurl layers, and in many instances the coatings are present in amounts that cause curling, a problem avoided with the transparencies of the present invention. This problem of curling can also be avoided by coating both sides of the transparency with the ink receiving layer, however, with such transparencies ink is usually undesirably transferred from the printed to the nonprinted side during stacking, a problem avoided, or minimized with the transparencies of the present invention.

Disclosed in U.S. Pat. No. 4,865,914, the disclosure of which is totally incorporated herein by reference, are transparencies with, for example, a supporting substrate and thereover a blend comprised of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid); (8) poly(vinyl alcohol); (9) poly(vinyl pyrrolidone); and (10)

hydroxypropyl methyl cellulose. Also, ink jet papers are illustrated in the aforementioned patent comprised, for example, of a supporting substrate and thereover a blend comprised of poly(ethylene oxide), and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide/acrylic acid copolymer; (6) cellulose sulfate; (7) poly(2-acrylamido-2-methyl propane sulfonic acid); (8) poly(vinyl alcohol); (9) poly(vinyl pyrrolidone); and (10) hydroxypropyl methyl cellulose; and dispersed in the blend colloidal silica.

Although the transparencies illustrated in the prior art are suitable for their intended purposes, there remains a need for other transparencies that are useful in ink jet printing processes, electrophotographic imaging and printing processes, including color processes, and that will enable the formulation of images with high optical densities. Additionally, there is a need for transparencies or transparent substrate materials for receiving or containing developed inked images wherein curling is avoided or minimized, and ink does not normally transfer from the printed to the nonprinted side of the transparency during stacking thereof. There is also a need for coated papers that are useful in electrostatographic imaging processes wherein images with excellent resolution and no background deposits are obtained. Another need resides in providing transparencies with coatings that do not block (stick) at, for example, 80 percent relative humidity or lower relative humidities in most embodiments, and at a temperature of 80° F. Further, there is a need for transparencies that avoid or minimize jamming at the fuser roll present, for example in imaging apparatuses, thus shorting the life thereof. Also, there is a need for static free transparencies, that is wherein the static charge thereon is minimized or substantially avoided. These and other needs are achievable with embodiments of the present invention.

SUMMARY OF THE INVENTION

It is an object of the present invention to provide transparencies with many of the advantages illustrated herein.

Another object of the present invention resides in the provision of ink jet transparencies, or xerographic transparencies with certain coatings.

Also, in another object of the present invention there are provided inked transparencies with layered coatings thus enabling images with high optical densities.

Furthermore, in another object of the present invention there are provided transparencies or transparent substrate materials for receiving or containing developed inked images wherein curling is avoided, or minimized, and wherein the transparency contains an anticurl layer, or layers such as, for example, a vinyl alcohol/vinyl acetate copolymer overcoated with hydroxypropylmethyl cellulose, which layer or layers can function as a moisture resistant component, thus enabling, for example, minimization or avoidance of curling, and/or the other advantages indicated herein.

Another object of the present invention resides in ink jet transparencies that permit the substantial elimination of beading caused by poor inter-drop coalescence during mixing of the primary colors to generate secondary colors such as, for example, mixtures of cyan and yellow enabling green colors.

Furthermore, in another object of the present invention there are provided electrophotographic transparencies that enable elimination or minimization of bleeding of colors due to intermingling or diffusion of dyes when different colors, for example black, are printed together with another color like magenta.

Moreover, another object of the present invention resides in xerographic transparencies that have substantial permanence for extended time periods.

Another object of the present invention relates to transparencies with specific layered coatings which enable water and glycol absorption from the inks selected in a rapid manner thereby enabling such coatings to be particularly useful in known ink jet printers.

In yet another object of the present invention there are provided coatings which are compatible with filled papers, sized papers and opaque substrates such as Mylars, and which coatings will enable the generation of high optical density images with electrophotographic processes, and wherein curling is avoided or minimized.

Additionally, in another object of the present invention there are provided transparencies for xerographic imaging wherein the post solvent treatment of the toner resin selected for image development is eliminated in some embodiments. In another object of the present invention there are provided transparencies wherein ink, in most instances, does not transfer from the printed to the nonprinted side of the transparency during their stacking, for example, under environmental conditions of 20 to 80 percent relative humidity and 80° F.

These and other objects of the present invention are accomplished by providing transparencies and papers with coatings. More specifically, in accordance with one embodiment of the present invention there are provided transparencies and papers with coatings thereover and thereunder which are compatible with the inks selected for marking, and wherein the coatings enable acceptable optical density images to be obtained, and wherein curling is avoided or minimized. Specifically, in one embodiment of the present invention there are provided transparencies or transparent substrate materials for receiving or containing developed inked images comprised of a supporting substrate, thereover a first coating of an ink receiving layer or plurality of layers, including two layers, and thereunder multi-layered, and preferably a two-layered anticurl coating.

One embodiment of the present invention is directed to a transparent substrate material for receiving or containing an image, which transparent substrate is comprised of a supporting base, an anticurl layered coating thereunder and an ink receiving layer or layers thereover, that is over the supporting substrate. Moreover, in a specific embodiment of the present invention there is provided a transparent substrate material for receiving or containing an inked image comprised of a supporting substrate; an anticurl coating layer or layers thereunder comprised of a first and second layer wherein the first layer in contact with the substrate is comprised of polymers containing hydrophilic and hydrophobic segments and the second layer in contact with and present on the first layer is comprised of hydrophilic cellulosic polymers or acrylamide polymers; and an ink receiving layer over the supporting substrate, thus the supporting substrate is situated between the ink receiving layer or layers and the anticurl layer or layers.

Specific embodiments of the present invention include transparencies comprised of a supporting substrate such as a polyester, which substrate contains thereunder an anticurl coating comprised, for example, of two layers wherein the first layer in contact with the substrate is selected from the group consisting of hydrophilic/hydrophobic polymers such as (1) a vinyl alcohol/vinyl acetate copolymer with a vinyl alcohol content of from about 5 to about 60 percent by weight; (2) a vinyl alcohol/vinyl butyral copolymer with a vinyl alcohol content of from about 5 to about 50 percent by weight; (3) a vinyl caprolactom/vinyl pyrrolidone/dimethylamino ethylmethacrylate terpolymer with a vinyl caprolactom content of from about 5 to about 50 percent by weight, wherein the vinyl pyrrolidone content is from about 85 to about 10 percent by weight and a dimethylamino ethylmethacrylate content of from about 10 to about 40 percent by weight; (4) a monoalkylester of poly(vinylmethyl ether/maleic acid) where the alkyl component contains from 1 to about 10 carbon atoms such as ethyl, isopropyl or butyl, and the like. The second layer polymer present over the aforementioned first layer is selected from the group consisting of (1) hydroxyalkylmethyl cellulose; (2) sodium carboxymethyl cellulose; (3) hydroxyethyl cellulose; (4) ethylhydroxyethyl cellulose; (5) sodium carboxymethylhydroxyethyl cellulose; (6) methyl cellulose; (7) poly(acrylamide); (8) an acrylamide-acrylic acid copolymer; (9) cellulose sulfate; and the like. The ink receiving layer in this embodiment is comprised of blends of poly(ethylene oxide), mixtures of poly(ethylene oxide) with sodium carboxymethyl cellulose, mixtures of hydroxyalkylmethyl cellulose with poly(ethylene oxide), and a component selected from the group consisting of (1) vinylmethyl ether/maleic acid copolymer; (2) hydroxypropyl cellulose; (3) acrylamide/acrylic acid copolymer; (4) sodium carboxymethylhydroxyethyl cellulose; (5) hydroxyethyl cellulose; (6) water soluble ethylhydroxyethyl cellulose; (7) cellulose sulfate; (8) poly(vinyl alcohol); (9) poly(vinyl pyrrolidone); (10) poly(2-acrylamido-2-methyl propane sulfonic acid); (11) poly(diethylenetriamine-co-adipic acid); (12) poly(imidazoline) quaternized; (13) poly(N,N-dimethyl-3-5-dimethylene piperidinium chloride); (14) poly(ethylene imine) epichlorohydrin modified; (15) poly(ethylene imine) ethoxylated; blends of poly(α-methylstyrene) with a component selected from the group consisting of (1) poly(ethylene oxide); (2) chlorinated rubber; (3) chlorinated poly(propylene); (4) halogenated, including preferably chlorinated poly(ethylene); (5) poly(caprolactone); (6) poly(chloroprene); (7) poly(1,4-butylene adipate); (8) poly(vinylmethyl ether); (9) poly(vinylisobutyl ether); (10) styrene-butadiene copolymer; and, (11) ethyl cellulose; and the like. The selected halogenated polymers may have effective halogen and preferably chlorine contents of, for example, from about 25 to about 75 percent by weight, and the butadiene content in styrene-butadiene copolymers selected is preferably from about 25 to about 75 percent by weight.

Blends and mixtures include the components in effective amounts as indicated herein, including, for example, from about 5 to about 90 weight percent of one material, and about 90 to about 5 weight percent of a second, third or more than three materials in some embodiments of the present invention.

In another embodiment, the present invention is directed to ink jet transparencies or transparent substrate materials for receiving or containing developed inked images comprised of a supporting substrate such as a polyester; thereover an ink receiving hydrophilic coating layer that is in a preferred embodiment comprised of a blend of hydroxypropylmethyl cellulose, sodium carboxymethyl cellulose and poly(ethylene oxide) and the other blends illustrated herein; and thereunder a two-layered anticurl coating wherein the first layer in contact with the substrate is comprised of, for example, a vinyl alcohol/vinyl acetate copolymer and the second layer in contact with and over the first layer is comprised of hydroxyalkylmethyl cellulose. The hydrophilic ink receiving layer may contain optional fillers such as inorganic oxides, silicon dioxide, titanium dioxide and the like in effective amounts of, for example, from 1 to 10 percent by weight of the ink receiving polymer.

Another specific embodiment of the present invention is directed to xerographic transparencies or transparent substrate materials for receiving or containing developed inked images comprised of a supporting substrate such as a polyester; thereover a hydrophobic coating blend of poly(α-methylstyrene) and chlorinated rubber and the other blends illustrated herein; and thereunder a two-layered anticurl coating wherein the first layer is comprised of, for example, vinyl alcohol/vinyl butyral copolymer, and the second layer is comprised of sodium carboxymethyl cellulose. The hydrophilic ink receiving layer may also contain fillers such as colloidal silicon dioxides in effective amounts of, for example, from 1 to 5 percent by weight of the hydrophobic ink receiving coating.

The term "anticurl coatings" refers, for example, to coatings that will avoid or minimize curling of the transparencies when employed, for example, in ink jet or xerographic imaging processes. Furthermore, when ink jet transparencies are printed and stacked one over the other under environment conditions of, for example, 20 to 80 percent relative humidity at 80° F., the inks do not transfer from the printed to the nonprinted side and the transparencies do not exhibit a curl of more than 10 millimeters in most embodiments of the present invention.

Curl refers, for example, to the distance in millimeters between the base line of the 8½ inch arc (Xerox hanging curl standard template) and the midpoint of the arc. To measure curl, a sheet of a coated transparent substrate can be held with the thumb and forefinger in the middle of the upper edge (of the long 11 inches edge) and matched against pre-drawn standard Xerox template curves ranging between zero (flat) and 65 millimeters (highly curved). In the invention of the present application, most of the sheets had curve values between zero and 10 millimeters. The usually acceptable measured value for hanging curl for transparencies and papers selected of xerographic processes is between zero and 15 millimeters in most instances.

Resistance to humidity is the capacity of a transparency to control the blooming and bleeding of printed images where blooming represents intra-diffusion of dyes and bleeding represents inter-diffusion of dyes. The blooming test can be performed by printing a bold filled letter such as T on a transparency and placing the transparency in a constant environment chamber preset for humidity and temperature. The vertical and horizontal spread of the dye in the letter T is monitored periodically under a microscope. Resistance to humidity limit is established when the dyes selected begin to diffuse out of the letter T. The bleeding test is performed by printing a checker board square pattern of various different colors and measuring the inter-diffusion of colors as a function of humidity and temperature.

Typically, the anticurl, especially the two, layered coatings are present in a thickness of from about 3 to about 50 microns, the first layer in contact with the substrate being of a thickness of from 2 to about 25 microns and the second layer in contact with and over the first layer having a thickness of from 1 to about 26 microns. The ink receiving layer typically has a thickness of from about 2 to about 25 microns. Other thicknesses of outside the ranges mentioned may be selected, especially if some of the objectives of the present invention are achieved.

Illustrative examples of substrates with an effective thickness of, for example, from about 50 microns to about 125 microns, and preferably of a thickness of from about 100 microns to about 125 microns that may be selected for the transparencies of the present invention include Mylar, commercially available from E. I. Dupont; Melinex, commercially available from Imperial Chemicals, Inc.; Celanar, commercially available from Celanese; polycarbonates, especially Lexan; polysulfones; cellulose triacetate; poly(vinylchloride) cellophane, poly(vinyl fluoride); and the like, with Mylar being particularly preferred in view of its availability and lower costs.

Specific examples of hydrophilic ink receiving layer coatings for ink jet printing include binary blends comprised of from about 10 to about 90 percent by weight in water of poly(ethylene oxide) (POLYOX WSRN-3000 available from Union Carbide) and from about 90 to about 10 percent by weight of a component selected from the group consisting of (1) hydroxypropyl methyl cellulose (Methocel K35LV, available from Dow Chemical Company), (2) vinylmethyl ether/maleic acid copolymer (Gantrez S-95, available from GAF Corporation); (3) acrylamide/acrylic acid copolymer (Scientific Polymer Products), (4) sodium carboxymethylhydroxyethyl cellulose (CMHEC43H, 37L, available from Hercules Chemical Company; CMHEC43H is believed to be a high molecular weight polymer with carboxymethyl cellulose (CMC/hydroxyethyl cellulose (HEC) ratio of 4:3, CMHEC 37L is believed to be a low molecular weight polymer with CMC/HEC ratio of 3:7); (5) hydroxyethyl cellulose (Natrosol 250LR, available from Hercules); (6) water soluble ethylhydroxyethyl cellulose (Bermocoll, available from Berol Kem, AB, Sweden); (7) cellulose sulfate (Scientific Polymer Products); (8) poly(vinyl alcohol) (Scientific Polymer Products); (9) poly(vinyl pyrrolidone) (GAF Corporation); (10) hydroxybutylmethyl cellulose (Dow Chemical Company); (11) hydroxypropyl cellulose; (Klucel Type E, available from Hercules) (12) poly(2-acrylamido-2-methyl propane sulfonic acid) (Scientific Polymer Products); (13) methyl cellulose (Dow Chemical Company); (14) hydroxyethylmethyl cellulose (available as HEM from British Celanese Ltd., Tylose MH, MHK from Kalle A. G.); (15) poly(diethylene triamine-co-adipic acid) (Scientific Polymer Products); (16) poly(imidazoline) quaternized (Scientific Polymer Products); (17) poly(ethylene imine) epichlorohydrin modified (Scientific Polymer Products); (18) poly(N,N-dimethyl-3,5-dimethylene piperidinium chloride) (Scientific Polymer Products); (19) poly(ethylene imine) ethoxylated (Scientific Polymer Products); and (20) sodium carboxymethyl cellulose (CMC Type 7HOF available from Hercules Chemical Company; ternary blends comprised of from about 10 to about 50 percent by weight of poly(ethylene oxide), from about 85 to about 5 percent by weight of sodium carboxymethyl cellulose and from about 5 to about 45 percent by weight of a component selected from the group consisting of (1) hydroxypropyl methyl cellulose (Methocel K35LV, available from Dow Chemical Company), (2) vinylmethyl ether/maleic acid copolymer (Gantrez S-95, available from GAF Corporation); (3) acrylamide/acrylic acid copolymer (Scientific Polymer Products), (4) sodium carboxymethylhydroxyethyl cellulose (CMHEC43H, 37L, available from Hercules Chemical Company); (5) hydroxyethyl cellulose (Natrosol 250LR, available from Hercules); (6) water soluble ethylhydroxyethyl cellulose (Bermocoll, available from Berol Kem, AB, Sweden); (7) cellulose sulfate (Scientific Polymer Products); (8) poly(vinyl alcohol) (Scientific Polymer Products); (9) poly(vinyl pyrrolidone) (GAF Corporation); (10) hydroxybutylmethyl cellulose (Dow Chemical Company); (11) hydroxypropyl cellulose (Klucel Type E, available from Hercules); (12) poly(2-acrylamido-2-methyl propane sulfonic acid) (Scientific Polymer Products); (13) methyl cellulose (Dow Chemical Company); (14) hydroxyethylmethyl cellulose (available as HEM from British Celanese Ltd., and Tylose MH, MHK from Kalle A. G.); (15) poly(-diethylene triamine-co-adipic acid) (Scientific Polymer Products); (16) poly(imidazoline) quaternized (Scientific Polymer Products); (17) poly(ethylene imine) epichlorohydrin modified (Scientific Polymer Products); (18) poly(N,N-dimethyl-3, 5-dimethylene piperidinium chloride) (Scientific Polymer Products); and (19) poly-(ethylene imine) ethoxylated (Scientific Polymer Products); ternary blends of from about 10 to about 50 percent by weight of poly(ethylene oxide), from about 85 to about 5 percent by weight of hydroxyalkylmethyl cellulose (where alkyl is of from 1 to about 10 carbon atoms such as ethyl, propyl or butyl) and from about 5 to about 45 percent by weight of a component selected from the group consisting of (1) hydroxypropyl cellulose (Klucel Type E, available from Hercules); (2) vinylmethyl ether/maleic acid copolymer (Gantrez S-95, available from GAF Corporation); (3) acrylamide/acrylic acid copolymer (Scientific Polymer Products), (4) sodium carboxymethylhydroxyethyl cellulose (CMHEC43H, 37L, available from Hercules Chemical Company); (5) hydroxyethyl cellulose (Natrosol 250LR, available from Hercules); (6) water soluble ethylhydroxyethyl cellulose (Bermocoll, available from Berol kem, AB, Sweden); (7) cellulose sulfate (Scientific Polymer Products); (8) poly(vinyl alcohol) (Scientific Polymer Products); (9) poly(vinyl pyrrolidone) (GAF Corporation); (10) poly(2-acrylamido-2-methyl propane sulfonic acid) (Scientific Polymer Products); (11) methyl cellulose (Dow Chemical Company); (12) sodium carboxymethyl cellulose (CMC 7HOF); (13) poly(diethylene triamine-co-adipic acid) (Scientific Polymer Products); (14) poly(imidazoline) quaternized (Scientific Polymer Products); (15) poly-(ethylene imine) epichlorohydrin modified (Scientific Polymer Products); (16) poly(N,N-dimethyl-3,5-dimethylene piperidinium chloride) (Scientific Polymer Products); and (17) poly(ethyleneimine) ethoxylated (Scientific Polymer Products).

Illustrative specific examples of binary (two polymers) and ternary (three polymers) blends selected as ink receiving polymers for ink jet printing include binary blends of hydroxyethylmethyl cellulose, 75 percent by weight, and poly ethylene oxide, 25 percent by weight; binary blends of hydroxypropylmethyl cellulose, 80 percent by weight, and poly(ethylene oxide), 20 percent by weight; binary blends of hydroxybutylmethyl cellulose, 70 percent by weight, and poly(ethylene oxide), 30 percent by weight; binary blends of sodium carboxymethyl cellulose, 80 percent by weight, and poly(ethylene oxide), 20 percent by weight; ternary blends of hydroxyalkylmethyl cellulose, 50 percent by weight, sodium carboxymethyl cellulose, 25 percent by weight, and poly(ethylene oxide), 25 percent by weight; ternary blends of hydroxyalkylmethyl cellulose, 60 percent by weight, poly(ethylene oxide), 20 percent by weight, and poly(N,N-dimethyl-3,5-dimethylene piperidinium chloride), 20 percent by weight; or ternary blends of hydroxypropylmethyl cellulose, 50 percent by weight, poly(ethylene oxide), 25 percent by weight, and sodium carboxymethyl cellulose, 25 percent by weight, and the like. Binary blends of hydroxypropylmethyl cellulose, 80 percent by weight, and poly(ethylene oxide), 20 percent by weight, are preferred in some embodiments as these yield images of high optical density (when imaged, for example, in Xerox Corporation 4020 TM ink jet printers) such as 1.15 (black), 1.44 (magenta), 0.84 (cyan) and 0.57 (yellow), which images are resistant to humidity, for example between 20 to 80 percent humidity at 80° F.

Specific hydrophobic toner receiving layer coatings, preferably for xerographic imaging, include blends of from about 95 to about 5 percent by weight of poly(α-methyl styrene) (molecular weight M between $10^3$ to $10^5$ and available from Amoco as resin 18-290) and from 5 to about 95 percent by weight of a component selected from the group consisting of (1) poly(ethylene oxide) (POLY OX-WSRN 3000, available from Union Carbide); (2) halogenated such as chlorinated rubber (chlorine content 65 percent, available from Scientific Polymer Products); (3) halogenated such as chlorinated poly(propylene) (chlorine content 65 percent by weight, available from Scientific Polymer Products); (4) halogenated such as chlorinated poly(ethylene) (chlorine content 48 percent by weight, available from Scientific Polymer Products); (5) poly(caprolactone) (PLC-700, available from Union Carbide); (6) poly(chloroprene) (Scientific Polymer Products); (7) poly(1,4-butylene adipate) (Scientific Polymer Products); (8) poly(-vinylmethylether) (Lutonal M-40, available from BASF); and (9) poly(vinylisobutylether) (Lutonal 160, available from BASF); styrene-butadiene copolymers (Kraton 1102, Kraton 1652, available from Shell Company) and ethyl cellulose (Ethocel Type-N, available from Hercules). Examples of binary blends selected as toner receiving layer polymers for xerographic imaging include blends of poly(α-methyl styrene), 80 percent by weight, and poly(chloroprene), 20 percent by weight; blends of chlorinated rubber, 80 percent by weight, and poly(α-methyl styrene), 20 percent by weight; blends of poly(α-methyl styrene), 20 percent by weight, and styrene-butadiene copolymer, 80 percent by weight; blends of poly(α-methyl styrene), 20 percent by weight,k and ethyl cellulose, 80 percent by weight; blends of poly(α-methyl styrene) with chloroprene or ethyl cellulose or chlorinated rubber are usually preferred as transparencies coated with these polymers and imaged with a Xerox Corporation 1005 TM color copier yielded high optical density images of, for example, 1.6 (black), 1.40 (magenta), 1.50 (cyan), and 0.80 (yellow), which could not be lifted off with 3M scotch tape 60 seconds subsequent to their preparation.

The ink or toner receiving layer where the developed image is contained in an embodiment of the present invention may include filler components in various effective amounts such as, for example, from about 2 to about 25 weight percent. Examples of fillers include colloidal silicas preferably present, for example, in one embodiment in an amount of 5 weight percent (available as Syloid 74 from W. R. Grace Company); calcium carbonate, titanium dioxide (Rutile) and the like. While it is not desired to be limited by theory, it is believed that the primary purpose of the fillers is as a slip component for the transparency traction during the feeding process in the electrophotographic, especially xerographic apparatus. In ink jet printing, silica is used to enhance color mixing.

Specific examples of polymers selected for the first anticurl layer component include (1) a vinyl alcohol/vinyl acetate copolymer (with a vinyl alcohol content of 18 percent by weight, available from Scientific Polymer Products); (2) a vinyl alcohol/vinyl butyral copolymer (vinyl alcohol content of 19.5 percent by weight, available from Scientific Polymer Products); (3) a vinylcaprolactam/vinyl pyrrolidone/dimethylamino ethylmethylacrylate (Gaffix VC-713, available from GAF Corporation); (4) monoalkylesters of poly(vinylmethyl ether/maleic acid) (Gantrez ES-225, Gantrez ES-335, Gantrez ES-425, Gantrez ES-435), and the like. The second anticurl hydrophilic layer polymers include (1) hydroxypropylmethyl cellulose (Methocel K35 LV, available from Dow Chemical Company); (2) hydroxybutylmethyl cellulose (Dow Chemical Company); (3) hydroxyethylmethyl cellulose (HEM available from British Celanese Ltd., Tylose MH, MHK available from Kalle A-G); (4) hydroxyethyl cellulose (Natrosol 250LR, available from Hercules); (5) ethylhydroxyethyl cellulose (Bermocoll, available from Berol Kem., AB, Sweden); (6) sodium carboxymethyl cellulose (CMC 7HOF, available from Hercules); (7) sodium carboxymethyl hydroxyethyl cellulose (CMHEC 43H, 37L, available from Hercules); (8) methyl cellulose (Methocel-A, available from Dow Chemical Company); (9) poly(acrylamide) polymers (Scientific Polymer Products); (10) cellulose sulfate (Scientific Polymer Products), and the like.

The aforementioned anticurl and ink receiving layers can be present in various thicknesses as indicated herein depending upon the coatings selected and the other components utilized; however, generally the total thickness of the two anticurl coatings is from about 3 to about 50 microns and preferably from about 10 to about 25 microns, whereas the thickness of the ink receiving layer is from about 2 to about 25 microns and preferably from about 5 to about 15 microns. These coatings can be applied by a number of known techniques including reverse roll, solvent extrusion and dip coating processes. In dip coating, a web of material to be coated is transported below the surface of the coating material by a single roll in such a manner that the exposed site is saturated, followed by the removal of any excess coating by a blade, bar or squeeze rolls, and thereafter repeating this procedure for application of the other layered coating. With reverse roll coating, the premetered material is transferred from a steel applicator roll to the web material moving in the opposite direction on a backing roll. Metering is performed in the gap precision-ground stainless steel rolls. The metering roll is stationary or is rotating slowly in the opposite direction of the applicator roll. In slot extrusion coating, there is selected a flat die to apply coating materials with the die lips in close proximity to the web of material to be coated. Once the desired amount of coating has been applied to the web, the coating is dried at 25° to 100° C. in an air dyer.

In one specific process embodiment, the transparencies of the present invention can be prepared by providing a substrate such as Mylar (in roll form) in a thickness of from about 100 to about 125 microns and applying to one side of the Mylar by the known solvent extrusion process on a Faustel coater in a thickness of about 2 to about 25 microns, a hydrophilic/hydrophobic polymer such as a vinyl alcohol/vinyl acetate copolymer which copolymer is present in a concentration of 5 percent by weight in a solvent such as acetone. Thereafter, the coating is air dried at 60° C. and the resulting polymer layer is then overcoated on the Faustel coater with a hydrophilic layer in a thickness of about 1 to about 25 microns of, for example, hydroxypropylmethyl cellulose present in a concentration of 4 percent by weight in a mixture of water (75 percent by weight) and methanol (25 percent by weight). Subsequent to air drying at a temperature of 100° C., an anticurl two-layered coating on one side of the two-sided substrate is obtained. After rewinding the coated side of the Mylar on an empty core, the uncoated side of the Mylar is coated in a thickness of from 2 to about 25 microns with an ink receiving hydrophilic coating layer such as blends of hydroxypropylmethyl cellulose, 80 percent by weight, and poly(ethylene oxide), 20 percent by weight, which blend is present in a concentration of 3 percent by weight in water. Thereafter, the coating is air dried and the resulting transparency can be used in Xerox Corporation 4020 TM color ink jet printers, and the like as indicated herein. Other transparencies of the present invention can be prepared in a similar or equivalent manner, and wherein different components are selected, for example, or other processes are utilized.

In other specific process embodiment, the transparencies of the present invention are prepared by providing a Mylar substrate (in roll form) in a thickness of from 100 to 125 microns and applying to one side of the Mylar by the known solvent extrusion process on a Faustel coater, in a thickness of from about 2 to about 25 microns, a hydrophilic/hydrophobic copolymer such as a vinyl pyrrolidone/vinyl acetate, which copolymer is present in a concentration of 10 percent by weight in isopropanol. Thereafter, the coating is air dried at 100° C. and the resulting polymer layer is overcoated with sodium carboxymethyl cellulose (in a thickness of 1 to 25 microns) present in a concentration of 2 percent by weight in water. Subsequent to air drying at 100° C., an anticurl two-layered coating is obtained on one side of the Mylar. Rewinding the coated side on an empty core and using this roll, the uncoated side of the Mylar roll is coated, in a thickness of from 2 to 25 microns, with a hydrophobic ink receiving layer blend of chlorinated rubber, 80 percent by weight, and poly(α-methyl styrene), 20 percent by weight, which blend is present in a concentration of 3 percent by weight in toluene. Thereafter, the coating is air dried at 100° C. and the resulting transparency can be utilized in a xerographic imaging apparatus such as those available commercially as the Xerox Corporation 1005 TM, and images can be obtained with, for example, optical density values of, for example, 1.6 (black), 0.85 (yellow), 1.45 (magenta) and 1.45 (cyan). Other transparencies of the present invention can be prepared in a similar or equivalent manner, and wherein different components are selected, for example, or other processes are utilized.

In the known formation and development of xerographic images, there is generally applied to a latent image generated on a photoconductive member a toner composition (dry or liquid) of resin particles and pigment particles. Thereafter, the image can be transferred to a suitable substrate such as natural cellulose, nevertear papers, the transparencies, plastic papers, and the like of the present invention, and affixed thereto by, for example, heat, pressure or combination thereof.

The known ink jet printing imaging process involves the use of one or more ink jet assemblies connected to a pressurized source of ink, which is comprised of water, glycols, and a colorant such as magenta, cyan, yellow or black dyes. Each individual ink jet includes a very small orifice usually of a diameter of 0.0024 inch, which is energized by magneto restrictive piezoelectric means for the purpose of emitting a continuous stream of uniform droplets of ink at a rate of 33 to 75 kilohertz. This stream of droplets is desirably directed onto the surface of a moving web of, for example, the transparencies and the like of the present invention, which stream is controlled to permit the formation of printed characters in response to video signals derived from an electronic character generator and in response to an electrostatic deflection system.

The optical density measurements recited herein, including the working Examples, were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

The following examples are being supplied to further define specific embodiments of the present invention, it being noted that these examples are intended to illustrate and not limit the scope of the present invention. Parts and percentages are by weight unless otherwise indicated.

EXAMPLE I

There were prepared by the solvent extrusion process (single side each time initially) 10 coated sheets or transparencies on a Faustel Coater by providing for each a Mylar substrate (roll form) in a thickness of 75 microns and a coating layer thereover of a copolymer of vinyl alcohol/vinyl acetate (vinyl alcohol content 18 percent by weight), which copolymer was present in a concentration of 5 percent by weight in a mixture of methyl acetate (35 percent by weight) and acetone (65 percent by weight). Subsequent to air drying at 60° C. and monitoring the difference in weight prior to and subsequent to coating, the dried Mylar rolls had present on one side thereof 0.8 gram, 8 microns in thickness, of vinyl alcohol/vinyl acetate copolymer layer. The dried copolymer layers were then overcoated on the Faustel Coater in each instance with a second anticurl hydrophilic layer of hydroxypropylmethyl cellulose present in a concentration of 4 percent by weight in a mixture of water (75 percent by weight) and methanol (25 percent by weight). Subsequent to air drying at a temperature of 100° C. and monitoring the difference in weight prior to and subsequent to coating, the coated sheets had present 0.7 gram, in a thickness of 7 microns, of the hydrophilic polymer in contact with the vinyl alcohol/vinyl acetate copolymer. Rewinding the coated side of the Mylars on an empty core and using these rolls, the uncoated sides of the Mylar were coated in each instance (10 sheets) with a blend of a hydrophilic ink receiving layer of sodium carboxymethyl cellulose (25 percent by weight), poly(ethylene oxide) (25 percent by weight) and hydroxypropylmethyl cellulose (50 percent by weight), which blend was present in a concentration of 4 percent by weight in water. Subsequent to air drying at 100° C. and monitoring the weight prior to and subsequent to coating, the coated sheets contained 0.8 gram, in a thickness of 8 microns, of the ink receiving layer. These sheets (10) were then fed individually into a Xerox Corporation 4020 TM ink jet color printer having incorporated therein four separate developer inks (commercially available and obtained from Sharp Inc. as inks for the 4020 TM ) comprised of water, glycols, and magenta, cyan, yellow or black dyes, respectively; and there were obtained images or the ink receiving layers with average optical densities for the 10 sheets of 1.15 (black), 1.34 (magenta), 0.84 (cyan) and 0.57 (yellow). These imaged transparency sheets were stacked one over the other (the image side of one sheet in contact with the nonimaged side of the other sheet) and placed in an environment chamber preset at 80° F. and 80 percent relative humidity (RH) for a period of 24 hours. Under these conditions, there was no transfer of colors from the imaged side of one sheet or transparency to the nonimaged side of the other sheet as the optical density of the images remained unchanged. The imaged sheets did not stick together and yielded a curl value of zero. On lowering the humidity of the environment chamber from 80 percent to 20 percent, the imaged sheets evidenced an acceptable curl value of between zero and 10 millimeters and there was no transfer of ink from one sheet or transparency to the other sheet or transparency.

EXAMPLE II

There were prepared by the solvent extrusion process (single side each time initially) by essentially repeating the process of Example I, 10 coated transparencies on a Faustel Coater providing a Mylar substrate (roll form) in a thickness of 100 microns and a coating thereover of a copolymer vinyl alcohol/vinyl butyral (vinyl alcohol content of 19.5 percent by weight), which solution was present in a concentration of 5 percent by weight in a mixture of toluene (60 percent by weight) and 1-butanol (40 percent by weight). Subsequent to air drying at 100° C. and monitoring the difference in weight prior to and subsequent to coating, the dried Mylar roll had on one side 0.9 gram, 9 microns in thickness, of the vinyl alcohol/vinyl butyral copolymer. The aforementioned dried copolymer layer was then overcoated on the Faustel Coater with a hydrophilic layer of sodium carboxymethyl cellulose, which cellulose was present in a concentration of 2 percent by weight in water. Subsequent to air drying at a temperature of 100° C. and monitoring the difference in weight prior to and subsequent to coating, each of the 10 coated sheets had present 0.6 gram, 6 microns in thickness, of the hydrophilic polymer in contact with the vinyl alcohol/vinyl butyral copolymer. Rewinding the coated side of the Mylar with the aforesaid two anticurl layers on an empty core, and using this roll, the uncoated side of Mylar was coated with a layer blend of a hydrophilic ink receiving layer of hydroxypropylmethyl cellulose (80 percent by weight) and poly(ethylene oxide) (20 percent by weight), which blend was present in a concentration of 4 percent by weight in water. Subsequent to air drying at 100° C. and monitoring the weight prior to and subsequent to coating, each of the coated sheets contained 0.8 gram, in a thickness of 8 microns, of the ink receiving layer. The 10 transparency sheets were then fed individually into a Xerox Corporation 4020 TM ink jet color printer as in Example I and there were obtained images with average optical densities of 1.10 (black), 1.25 (magenta), 0.80 (cyan) and 0.57 (yellow). These imaged sheets were stacked one over the other and placed in an environment chamber preset at 80° F. and 80 percent RH for a period of 24 hours. Under these conditions, there was no transfer of colors from the imaged side of one sheet to the nonimaged side of the other as the optical density of the images remained unchanged. The imaged sheets did not stick together and yielded a curl value of zero. On lowering the humidity (RH) of the environment chamber from 80 percent to 20 percent, the imaged sheets yielded curl values of between zero and 10 millimeters and there was no ink transfer from one transparency sheet to the other transparency sheet.

EXAMPLE III

There were prepared by the known solvent extrusion process (single side each time) by essentially repeating the procedure of Example I, coated transparency sheets on a Faustel Coater by providing a Mylar substrate (roll form) in a thickness of 100 microns and a coating thereover of a copolymer of vinyl alcohol/vinyl acetate (vinyl alcohol content of 18 percent by weight), which solution was present in a concentration of 2 percent by weight in a mixture of toluene (60 percent by weight) and 1-butanol (40 percent by weight). Subsequent to air drying at 100° C. and monitoring the difference in weight prior to and subsequent to coating, the dried Mylar roll had on one side 0.3 gram, 3 microns in thickness, of the vinyl alcohol/vinyl acetate copolymer. The dried copolymer layer was then overcoated on the Faustel Coater with a second anticurl layer of a hydrophilic layer of sodium carboxymethyl cellulose, which cellulose was present in a concentration of 1 percent by weight in water. Subsequent to air drying at a temperature of 100° C. and monitoring the difference in weight prior to and subsequent to coating, the 10 coated transparent sheets had present 0.3 gram, 3 microns in thickness, of the hydrophilic polymer in contact with the vinyl alcohol/vinyl acetate copolymer. Rewinding the coated side of the Mylar on an empty core, and using this roll with the aforesaid two anticurl layers, the uncoated side of Mylar was coated with a blend of a hydrophobic ink receiving layer of poly(α-methylstyrene) (Amoco resin 18-29) (80 percent by weight) and poly(chloroprene) (20 percent by weight), which blend was present in a concentration of 2 percent by weight in toluene. Subsequent to air drying at 100° C. and monitoring the weight prior to and subsequent to coating, the coated sheets had 0.3 gram, in a thickness of 3 microns, of the ink receiving layer. The resulting 10 transparency sheets were then fed individually into a Xerox Corporation 1005 TM color xerographic imaging apparatus. The average optical density of the images was 1.6 (black), 0.80 (yellow), 1.40 (magenta) and 1.50 (cyan). These images could not be handwiped or lifted off with 3M scotch tape 60 seconds subsequent to their preparation. The curl value of these sheets before and after printing was in the acceptable range of zero to 10 millimeters.

Other modifications of the present invention will occur to those skilled in the art subsequent to a review of the present application. These modifications, including equivalents thereof, are intended to be included with the scope of the present invention.

What is claimed is:

1. A transparent substrate material for receiving or containing an inked image comprised of a supporting substrate; an anticurl coating thereunder comprised of a first and second layer wherein the first layer in contact with the substrate is comprised of polymers containing hydrophilic and hydrophobic segments, and the second layer in contact with and present on the first layer is comprised of hydrophilic cellulosic polymers or acrylamide polymers; and an ink receiving layer wherein the supporting substrate is situated between the anticurl coating and the ink receiving layer.

2. A material in accordance with claim 1 wherein the hydrophilic/hydrophobic segment containing polymers of the first layer of the anticurl coating are selected from the group consisting of (1) a vinyl alcohol/vinyl acetate copolymer with a vinyl alcohol content of from about 5 to about 60 percent by weight; (2) a vinyl alcohol/vinyl butyral copolymer with vinyl alcohol content of from about 5 to about 50 percent by weight; (3) a vinyl caprolactone/vinyl pyrrolidone/dimethylamino ethylmethacrylate terpolymer with vinyl caprolactom content of from about 5 to about 50 percent by weight, a vinyl pyrrolidone content of from about 85 to about 10 percent by weight and a dimethylamino ethylmethacrylate content of from about 10 to about 40 percent by weight; and (4) a mono alkyl ester of poly(methyl vinyl ether/maleic acid).

3. A material in accordance with claim 1 wherein the second layer hydrophilic cellulosic or acrylamide polymers are selected from the group consisting of (1) hydroxyethylmethyl cellulose; (2) hydroxypropyl methyl cellulose; (3) hydroxybutyl methyl cellulose; (4) sodium carboxymethyl cellulose; (5) sodium carboxymethyl hydroxyethyl cellulose; (6) water soluble ethylhydroxyethyl cellulose; (7) hydroxyethyl cellulose; (8) methyl cellulose; (9) poly(acrylamide); and (10) acrylamide/acrylic acid copolymer.

4. A material in accordance with claim 1 wherein the ink receiving layer selected for ink jet printing processes is comprised of a blend of from about 10 to about 90 percent by weight of poly(ethylene oxide) and from about 90 to about 10 percent by weight of a component selected from the group consisting of (1) hydroxypropyl methyl cellulose; (2) vinylmethyl ether/maleic acid copolymer; (3) acrylamide/acrylic acid copolymer; (4) sodium carboxymethylhydroxyethyl cellulose; (5) hydroxyethyl cellulose; (6) water soluble ethylhydroxyethyl cellulose; (7) cellulose sulfate; (8) poly(vinyl alcohol); (9) poly(vinyl pyrrolidone); (10) hydroxybutylmethyl cellulose; (11) hydroxypropyl cellulose; (12) poly(2-acrylamido-2-methyl propane sulfonic acid); (13) methyl cellulose; (14) hydroxyethylmethyl cellulose; (15) poly(diethylene triamine-co-adipic acid); (16) poly(imidazoline) quaternized; (17) poly(ethylene imine) epichlorohydrin modified; (18) poly(N,N-dimethyl-3,5-dimethylene piperidinium chloride); (19) poly(ethylene imine) ethoxylated; and (20) sodium carboxymethyl cellulose.

5. A material in accordance with claim 1 wherein the ink receiving layer selected for ink jet printing processes is comprised of a blend from about 10 to about 50 percent by weight of poly(ethylene oxide), from about 85 to about 5 percent by weight of sodium carboxymethyl cellulose, and from about 5 to about 45 percent by weight of a component selected from the group consisting of (1) hydroxypropyl methyl cellulose; (2) vinylmethyl ether/maleic acid copolymer; (3) acrylamide/acrylic acid copolymer; (4) sodium carboxymethylhydroxyethyl cellulose; (5) hydroxyethyl cellulose; (6) water soluble ethylhydroxyethyl cellulose; (7) cellulose sulfate; (8) poly(vinyl alcohol); (9) poly(vinyl pyrrolidone); (10) hydroxybutylmethyl cellulose; (11) hydroxypropyl cellulose; (12) poly(2-acrylamido-2-methyl propane sulfonic acid); (13) methyl cellulose; (14) hydroxyethylmethyl cellulose; (15) poly(diethylene triamine-co-adipic acid); (16) poly(imidazoline) quaternized; (17) poly(ethylene imine) epichlorohydrin modified; (18) poly(N,N-dimethyl-3,5-dimethylene piperidinium chloride); and (19) poly(ethylene imine) ethoxylated.

6. A material in accordance with claim 1 wherein the ink receiving layer selected for ink jet printing processes is comprised of a blend of about 10 to about 50 percent by weight of poly(ethylene oxide), from about 85 to about 5 percent by weight of a hydroxy alkyl methyl cellulose, and from about 5 to about 45 percent by weight of a component selected from the group consisting of (1) hydroxypropylcellulose; (2) vinylmethylether/maleic acid copolymer; (3) acrylamide/acrylic acid copolymer; (4) sodium carboxymethylhydroxyethyl cellulose; (5) hydroxyethyl cellulose; (6) water soluble ethylhydroxyethyl cellulose; (7) cellulose sulfate; (8) poly(vinyl alcohol); (9) poly(vinyl pyrrolidone); (10) poly(2-acrylamide-2-methyl-propane sulfonic acid; (11) poly(diethylene triamine-co-adipic acid); (12) poly(imidazoline) quaternized; (13) poly(N,N-dimethyl-3-5-dimethylene piperidinium chloride); (14) poly(ethylene imine) epichlorohydrin modified; (15) poly(ethylene imine) ethoxylated; and (16) sodium carboxymethyl cellulose.

7. A material in accordance with claim 1 wherein the ink receiving layer selected for xerographic imaging and printing processes is comprised of a blend of from about 95 to about 5 percent by weight of poly(alpha-methylstyrene) and from about 5 to 95 percent by weight of a component selected from the group consisting of (1) poly(ethylene oxide); (2) chlorinated rubber; (3) chlorinated poly(propylene); (4) chlorinated poly(ethylene); (5) poly(caprolactone); (6) poly(chloroprene); (7) poly(1,4-butylene adipate); (8) poly(vinylmethylether); (9) poly(vinyl isobutyl ether); (10) styrene-butadiene copolymer; and (11) ethyl cellulose.

8. A material in accordance with claim 7 wherein the chlorinated component polymers possess a chlorine content of from abou 25 to 75 percent by weight.

9. A material in accordance with claim 7 wherein the butadiene content of the styrene-butadiene copolymer is from about 25 to about 75 percent by weight.

10. A material in accordance with claim 1 wherein the substrate is of a thickness of from about 75 to about 125 microns, the ink receiving layer on the top of the substrate is of a thickness of from about 2 to about 25 microns, and the two layered anticurl coating underneath the substrate is of a thickness of from about 3 to about 50 microns.

11. A material in accordance with claim 10 wherein the first layer of the two layered anticurl coating underneath the substrate and in contact therewith is of a thickness of from about 2 to about 25 microns, and the second anticurl layer over the first anticurl layer is of a thickness of from about 1 to about 25 microns.

12. A material in accordance with claim 1 wherein the ink receiving layer contains filler.

13. A material in accordance with claim 12 wherein the filler is comprised of colloidal silicas, calcium carbonate, titanium dioxide or mixtures thereof.

14. A material in accordance with claim 13 wherein the filler or mixtures thereof are present in an amount of from 2 to about 25 percent by weight of the ink receiving layer.

15. A material in accordance with claim 1 wherein the supporting substrate is selected from the group consisting of cellulose acetate, poly(sulfone), poly(vinyl fluoride) cellophane, poly(propylene), poly(vinyl chloride) and poly(ethylene terephthalate).

16. A transparency comprised of a supporting substrate; an anticurl coating thereunder comprised of a first and second layer wherein the first layer in contact with the substrate is comprised of polymers containing hydrophilic and hydrophobic segments and the second layer in contact with and present on the first layer is comprised of hydrophilic cellulosic polymers or acrylamide polymers; and an ink receiving layer thereover.

17. A coated paper for receiving or containing images comprised of a supporting substrate, a plurality of anticurl coating layers and an ink receiving layer, wherein the anticurl coating is comprised of a first and second layer, wherein the first layer in contact with the substrate is comprised of polymers containing hyrophilic and hydrophobic segments and the second layer in contact with and present on the first layer is comprised of hydrophilic cellulosic polymers or acrylamide polymers.

* * * * *